United States Patent [19]

Sandy

[11] 4,197,961

[45] Apr. 15, 1980

[54] CONTAINER AND LIP ATTACHMENT THEREFOR

[76] Inventor: Alston C. Sandy, 10520 Scaggsville Rd., Laurel, Md. 20810

[21] Appl. No.: 964,409

[22] Filed: Nov. 28, 1978

[51] Int. Cl.[2] ..... B65D 25/00; B65D 41/00

[52] U.S. Cl. ..... 220/354; 220/90

[58] Field of Search ..... 220/90, 354, 355; 15/257.05; 401/121, 122

[56] References Cited

U.S. PATENT DOCUMENTS

| | | | |
|---|---|---|---|
| 1,616,288 | 2/1927 | Taliaferro | 220/354 |
| 1,696,240 | 12/1928 | Kircher, Jr. | 220/90 |
| 1,847,245 | 3/1932 | Hothersall | 220/354 X |
| 2,124,929 | 7/1938 | Reid | 220/90 |
| 2,342,454 | 2/1944 | Coyliondro | 220/90 |
| 2,767,891 | 10/1956 | Beadles | 220/90 X |
| 2,801,762 | 8/1957 | Atherton | 220/90 X |
| 3,298,561 | 1/1967 | McConnie | 220/90 |
| 3,329,307 | 7/1967 | Jacobson | 220/90 |
| 3,383,006 | 5/1968 | Kulze | 220/355 |
| 3,776,415 | 12/1973 | Pfeffer | 220/90 |

FOREIGN PATENT DOCUMENTS

| | | | |
|---|---|---|---|
| 147446 | 9/1951 | Australia | 220/90 |
| 177983 | 3/1921 | United Kingdom | 220/90 |

*Primary Examiner*—Allan N. Shoap

*Attorney, Agent, or Firm*—Geoffrey R. Myers

[57] ABSTRACT

Provided is an attachment for the underside of the drip lip of a can insertable during can manufacture without interfering with sealing engagement of the can with the top. The attachment comprises a section of a top for the can defined by a cord line across the top. The attachment so retained in position by mating the circumferential convolutions in the attachment with the underside convolutions in the drip lip.

6 Claims, 7 Drawing Figures

CONTAINER AND LIP ATTACHMENT THEREFOR

This invention relates to a container and an attachment therefore. More particularly, this invention relates to an attachment for a container which provides a blade edge across the opening of the container which may be used to remove the container's contents.

Containers (cans) used to hold paint, putty, cement and the like are well known. As illustrated in FIGS. 1–4, they usually comprise a walled hollow structure provided with a lip (FIGS. 1–2) and a top (FIGS. 3–4) for sealing it. The lip, known at times as a "drip lip" is press-fit to the upstanding side wall of the container and extends inwardly therefrom in a generally u-shaped convoluted design which terminates in a small loop. The top is provided adjacent its peripheral edge with a similar u-shaped convolution of preselected size so that the top seals the can by press-fitting the u-shaped convolution of the top into that of the drip lip.

When the top is removed, the drip lip often is used by the painter, etc., as a wiping or scraping edge for an implement (e.g., paint brush or putty knife) which he is using to remove the can's contents. Th use of the drip lip for this purpose often results in inadequate wiping or scraping, causes the lip to fill and spill its contents down along the sides of the can, and makes tight resealing of the can a messy and difficult operation.

In order to overcome this problem, certain rather complex devices have been designed for attachment to the lip of the can so as to provide a wiping or scraping surface across the face or orifice of the open can when in use. Exemplary of such devices are those illustrated in the following U.S. Pat. Nos.:

3,776,415
3,329,307
3,298,561

Some of these devices are rather complex and thus, economically unattractive. Some require press fitting over the can top for shipment which among other disadvantages, exposes a sharp edge to those who may come in contact with the can before it is opened. In addition, the scraper edge is the termination of a flat surface which extends to the periphery of the can, thus allowing paint to run across the surface and down the sides of the can without a drip lip to inhibit it.

Other known devices are connected to the drip lip in such a way as to prohibit the top from being used to seal the can while retaining the device in place. Thus, the device cannot be installed during manufacture of the can and shipped with the filled can. Still other devices use the can top as its locus or form an integral extension of the drip lip, thus necessitating the redesign of conventional can top and lip tooling.

It is apparent from the above that there exists a need in the art for an attachment which presents an effective scraping or wiping edge across the open face (i.e., orifice) of a can, but which does not have the drawbacks of the known devices. It is a purpose of this invention to fulfill this and other needs apparent to the skilled artisan once given the following disclosure:

Generally speaking, this invention fulfills these needs, in whole or in part, by providing an attachment for the inner surface of a lip of an orificed, hollow container, said lip being connected to a wall of said container in which said orifice is located such that said lip defines at least a portion of the boundary of said orifice, said lip comprising a generally u-shaped convolution spaced from said wall and extending in a direction so as to define an open ended area of confinement, the attachment comprising a peripheral edge, a portion of which is compatible in shape with said open ended area and has adjacent thereto a generally u-shaped convolution and another position of which comprises a blade means such that when the generally u-shaped convolution of said attachment is matingly engaged with the convolution of the lip at the inner surface thereof by location of at least a portion of said convolution of said attachment within said open ended area of confinement the blade means extends across at least a portion of said orifice.

In certain preferred embodiments the attachment is a section of a spare can top and is provided with a second convolution to provide better retention when wiping, cutting or scraping action occurs across the blade edge.

This invention will now be described with reference to certain embodiments thereof as illustrated in the accompanying drawings, wherein:

IN THE DRAWINGS

Figure 1:
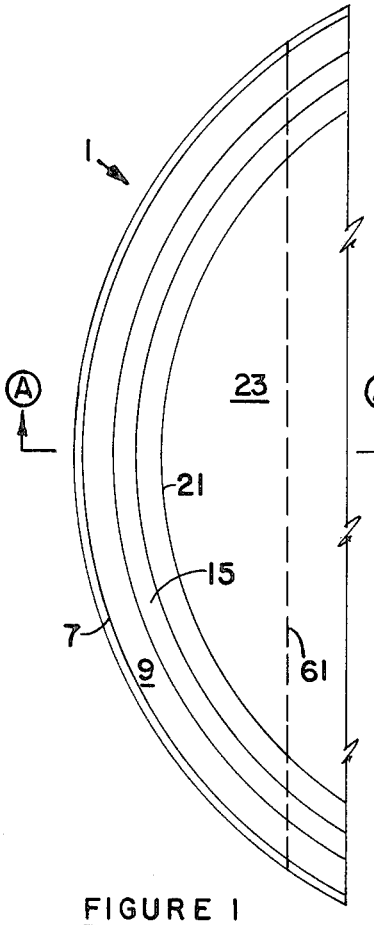
FIG. 1 is a top plan view of a portion of a known paint can useful in the practice of this invention.

With reference to the figures, there is illustrated a conventional, cylindrical can (e.g., paint can, spackle can, or the like) 1 comprising an upstanding, side wall 3 and a lip 5. Lip 5, in accordance with known techniques, is conventionally press-fit to the upper surface of wall 3 by curved press-fit surface 7 which extends over the outer surface of wall 3 around the top surface thereof, and downwardly along the inner surface of wall 3 until it turns laterally to form lateral surface 9.

Lateral surface 9 extends for a finite distance and terminates in downwardly extending leg 11 of lip convolution 13. Lip convolution 13 is generally u-shaped and includes a longer curved portion 15, connected in turn to upwardly extending leg 17. Upwardly extending leg 17 eventually terminates in loop 19. As illustrated, this lip extends about the entire periphery of the upper surface of wall 3 such that lip 19 defines the boundary of the orifice or open face of can 1. In addition, lip 5 because of convolution 13 is often referred to as a "drip" lip whereby in the prior art, as discussed hereinabove, the inner edge 21 of loop 19 often serves as a blade edge (i.e., wiper, scraper or cutter) for the implement after it is dipped into the paint, etc., through opening or orifice 23 and withdrawn.

Figure 3:
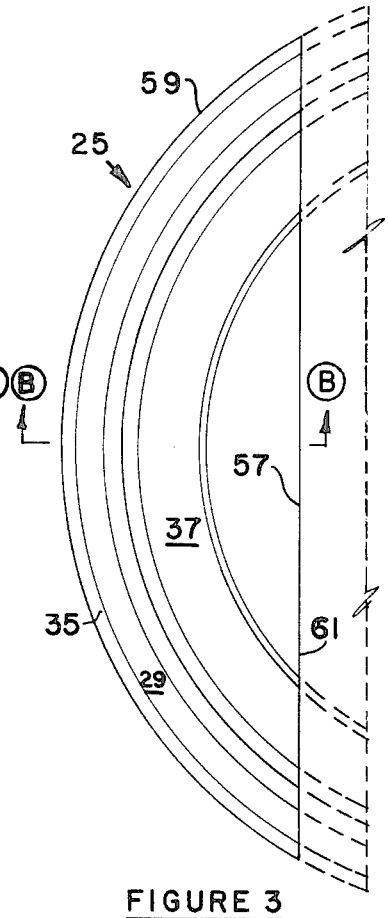
FIG. 3 is a top plan view of a portion of a known top for sealing the can shown in FIG. 1; wherein the solid lines illustrate an attachment according to this invention.
Figure 2:
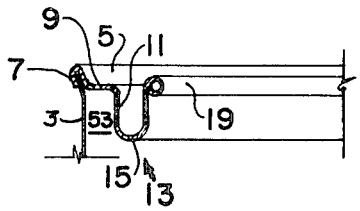
FIGURE 2 (PRIOR ART)
FIG. 2 is a side plan view of the paint can of FIG. 1, sectionalized along line A—A therein.
Figure 4:
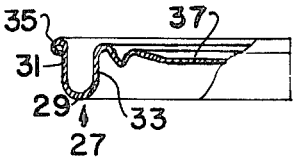
FIGURE 4 (PRIOR ART)
FIG. 4 is a side plan view of the can top attachment of FIG. 3, sectionalized along line B—B therein.
Figure 7:
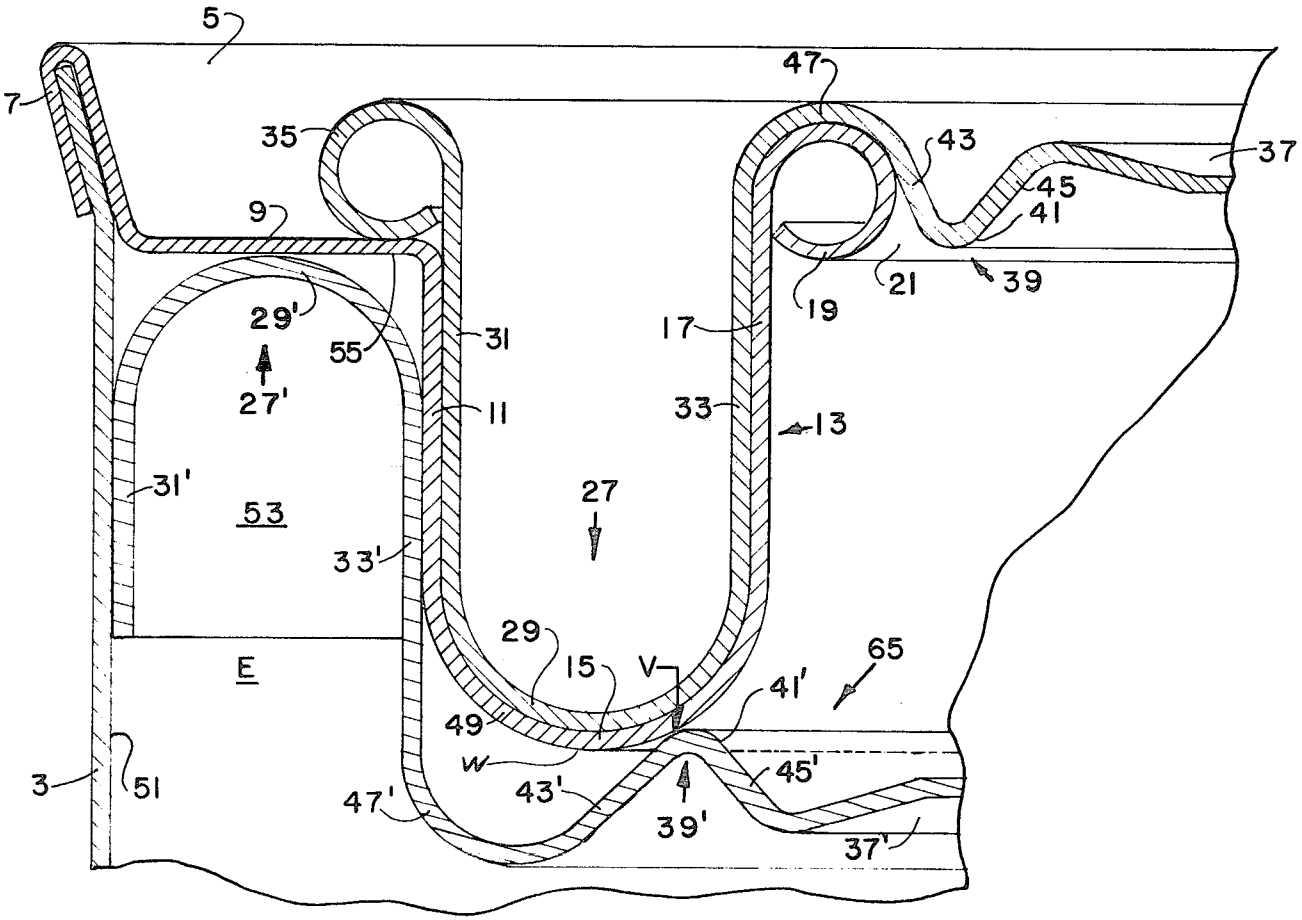
FIG. 7 is a side plan, sectionalized view of an attachment in another embodiment of a mating engagement with a can according to the practice of this invention.

In order to seal can 1 and as best illustrated in FIGS. 3,4, and 7, there has conventionally been provided a circular can top 25 having a convolution 27 built therein. Convolution 27 is generally u-shaped having a lower portion 29, upstanding legs 31 and 33 which terminate respectively in loop 35, and can top surface 37.

In addition to first convolution 27, top 25 is usually provided with a second convolution 39 which as illustrated in FIG. 7 is spaced at a lateral distance along the top surface 37 from the termination point of leg 33. Second convolution 39 comprises a lower portion 41 and upstanding side legs 43 and 45.

Can top 25 seals orifice 23 by being press-fit as illustrated best in FIG. 7 into convolution 27 of lip 5. This press-fit is accomplished most simply because of the flexible nature of the lateral walls of the general u-shaped convolution in both the lip 5 and top 25. Loop 35, loop 19 and loop wall 47 cooperate to further seal the orifice tightly.

Because of the construction of lip 5 and its convolution 27, whereby lateral surface 9 spaces convolution 27 from upstanding wall 3, there is provided between the inner surface 49 of convolution 27 and the inner surface 51 of wall 3 a space 53 open ended at E and defined thereby by the inner surface 51 of wall 3, the inner surface 55 of lateral surface 9, and the inner surface 49 of convolution 27, extending from the juncture of leg 11 and surface 9 downwardly to the vertex of the convolution. This space is useful in the practice of this invention for matingly engaging an attachment as contemplated by this invention for providing a blade surface across at least a portion of orifice 23, thereby to provide a wiping, scraping, or cutting edge as heretofore described and attempted to be achieved by the prior art.

One embodiment of an attachment as contemplated by this invention is illustrated in solid lines in FIG. 3. As illustrated, the attachment comprises a section or portion of top 23 obtained by a cord 57 cut across circle 59. There is nothing critical about where cord line 57 is located, cord 57 being located so as to give the desired size of the attachment necessary for accomplishing the purposes of this invention. This is most simply achieved, for example, in the manufacturing process of the can and its top by merely producing a given number of extra tops and cutting such tops along one or more cord lines drawn therein. The cord structure then serves as a convenient attachment in accordance with this invention.

Figure 5:
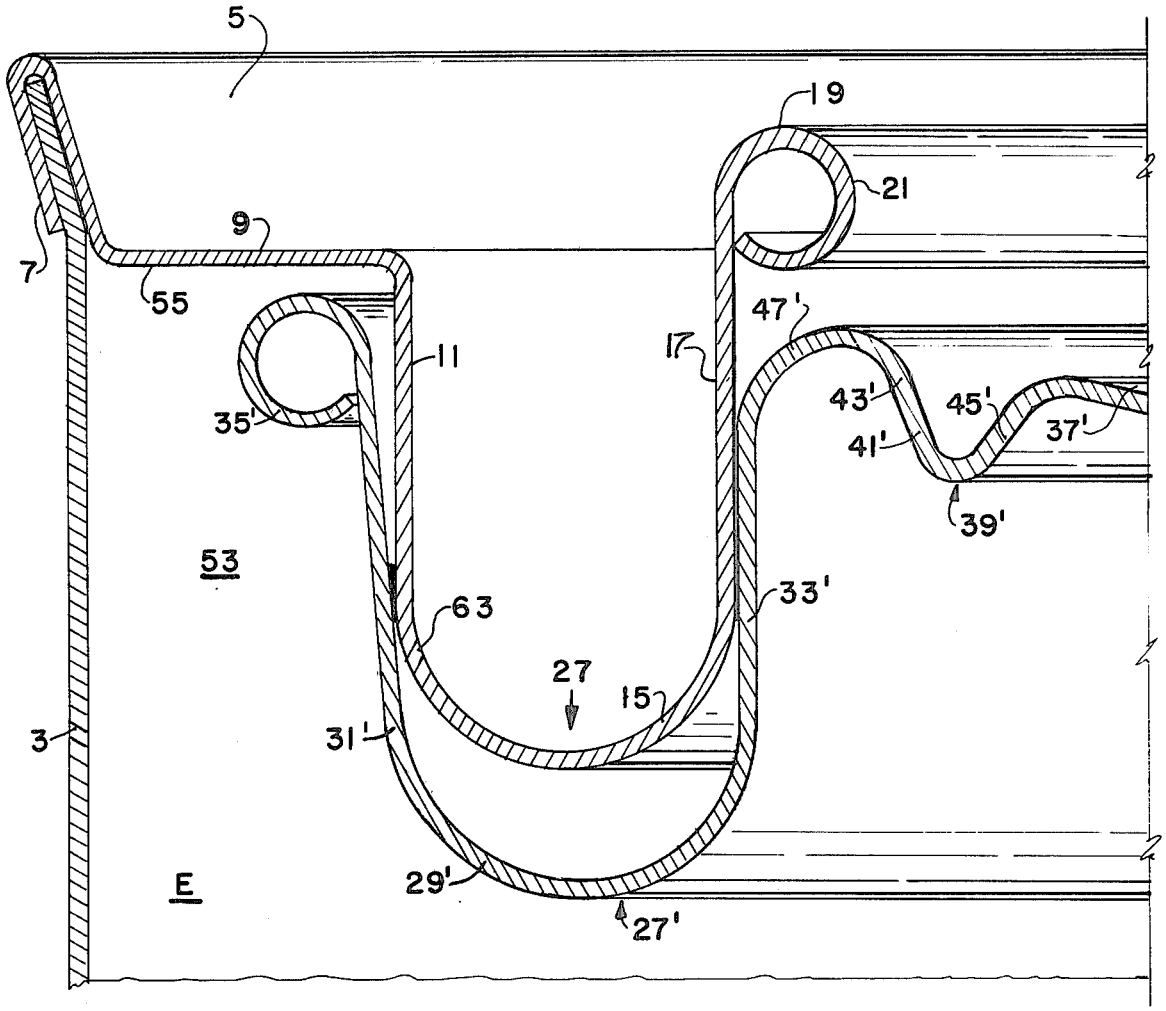
FIG. 5 is a side plan, sectionalized view of an attachment in one embodiment of a mating engagement with a can according to the practice of this invention.
Figure 6:
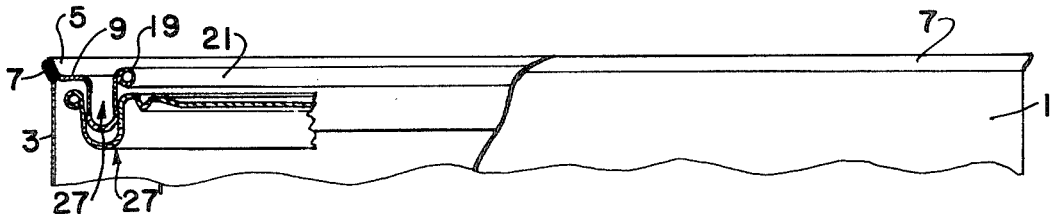
FIG. 6 is a side plan, sectionalized view of the engagement illustrated in FIG. 5.

One way of matingly engaging such an attachment in accordance with the practice of this invention is illustrated in FIGS. 5–6. Therein convolution 27′ is press-fit around the underside of convolution 27 of lip 5 so that there is abutting contact along portions of the peripheral surfaces of 27 and 27′. In this way, loop 35′ and downwardly extending leg 31′ are easily accommodated in open ended spaced 53. The press-fit is quite adequate to hold the attachment in place, thereby providing blade edge 61 in location across the open face of orifice 23 as shown in the dotted line in FIG. 1. In such a location, blade edge 61 conveniently provides an excellent wiping surface for a paint brush recently dipped into the paint (not shown) inside the can or other material which is in excess of the implement used to withdraw the contents therefrom. Since the attachment is located on the inner surface 49 of convolution 27, top 25, not shown in FIGS. 5–6, but illustrated in regard to FIG. 7 is still free to be press-fit within the outer surface 63 of convolution 27.

With regard to FIG. 7, there is illustrated a particularly preferred embodiment of matingly engaging an attachment (hereinafter referred to as attachment 65) on the inner surface of loop 5. In this embodiment, cord line 57 is drawn across can top 25 and the attachment is obtained by cutting along this line and cutting off loop 35′. Attachment 65 is then inverted from its normal "top" position and convolution 27 is inverted form is press-fit into space 53. Because loop 35′ has been removed, legs 31′ and 33′ are easily and flexibly slipped into space 53 and flex outwardly against the inner surface 51 and 49, respectively so as to hold attachment 65 securely therewithin. In certain preferred embodiments, the lower portion 29 of convolution 27′ may be inserted all the way into space 53 until its vertex contacts lower surface 55 of surface 9.

When attachment 65 is inserted in space 53 and because of the spacing of wall 47′, the vertex V of second convolution 39′ is in a plane higher than the vertex W of convolution 27 and on the opposite side of convolution 27 from where wall 33′ contacts wall 11. At times, the vertex V or a portion of wall 43′ adjacent thereto, may either be slightly spaced from, or actually contact upwardly extending wall 13 at its lower portion 29, but to the opposite side of vertex W from wall 11. In this way, an additional retaining mechanism is built into the attachment in that when the paint brush is wiped upwardly along blade edge 61, the contact between convolution 39′ and 27 causes a lateral force to be applied on the convolution 27 which translates into a lateral squeezing force against convolution 27′ thereby better retaining attachment 65 within space 53 as it experiences its maximum detachment force.

As further illustrated in FIG. 7, this engagement on the underside of lip 5 by attachment 65 in no way inhibits the full sealing engagement of top 25 in its normal, conventional sealing arrangement with lip 5. Thus, attachment 65 may be placed in the container during its manufacture, and shipped with the product internally of container 1 without exposing any sharp edges to those who come in contact with the can during shipment, purchase or the like.

Once given the above disclosure, many other features, modifications and improvements will become apparent to the skilled artisan. Such other features, modifications and improvements are therefore to be considered a part of this invention, the scope of which is to be determined by the following claims:

I claim:

1. In combination, a hollow container provided with a wall, an orifice in said wall, and a lip extending around at least a portion of the peripheral edge of the orifice, and an attachment connected to the container at the lip, the lip comprising a generally U-shaped first convolution, said first convolution extending downwardly into said hollow container such that the lowermost point of the "U" defines the inward extremity of the first convolution, said first convolution being attached to said wall by a plate means extending between said wall and an uppermost portion of one leg of said "U" such that said first convolution opens outwardly of said container and there is provided between said wall, plate means and said leg an inwardly open area of confinement of substantially uniform width and depth;

the attachment comprising a generally U-shaped second convolution, one leg of said "U" defining an outer peripheral edge of said attachment of substantially the same shape as the leg of the "U" of said first convolution to which said plate means is attached, and the other leg of said "U" of said second convolution having a blade means attached thereto, the dimensions of said U-shaped second convolution being such that the attachment may be connected to the lip by pressing the "U" of said first convolution with its lowermost point leading into the "U" of said second convolution such that the leg of the "U" of said second convolution which defines the outer peripheral edge of said attachment extends into said inwardly open area of confinement thereby to locate said blade means within a portion of said orifice and maintain the outwardly openness of said first convolution; and wherein when said first and second convolutions are in pressing engagement, there is formed a continuum along portions of peripheral surfaces thereof, retaining contact between respective legs of the "U's" of said first and second convolutions thereby to resist disengagement when a whipping force is applied to said blade means.

2. The combination of claim 1 which further includes a closure for said orifice, said closure comprising a third convolution matingly engageable in the outwardly open portion of said first convolution thereby being capable of closing said orifice which said attachment is secured to said lip.

3. In combination, a hollowed walled container having an orifice in a wall thereof, a blade means, and means for attaching said blade means to said container so as to locate said blade means within said orifice;

said container having a lip connected to a wall of said container in which said orifice is located such that said lip defines at least a portion of the boundary of said orifice, said lip comprising a generally U-shaped first convolution extending inwardly from said orifice and spaced from said wall by a plate means attached to one leg of said "U" thereby to define an inwardly open ended area of confinement between said wall and said leg of said U-shaped first convolution and positioning the "U" of said first convolution so as to be outwardly open;

the attaching means comprising a generally U-shaped second convolution, one leg of said "U" defining an outer peripheral edge of said attaching means and having substantially the same shape as the said wall of said container, and the other leg of said "U" of the second convolution having attached to an end portion thereof said blade means and being of substantially the same shape as the leg of the "U" of the first convolution to which said plate means is attached, the legs of said second convolution being joined by a vertex portion;

the dimensions of said U-shaped second convolution being such that the blade means may be attached to said container so as to locate said blade means within said orifice by pressing the second convolution with its vertex portion leading, into said inwardly open ended area of confinement, the outer peripheral edge of said attaching means thereby forming a substantially continuum of contact peripherally with the wall of said container and the leg of said second convolution to which said blade means is attached thereby forming a substantially continuum of contact peripherally with the leg of said first convolution to which said plate means is attached.

4. The combination of claim 3 wherein said first convolution has a leg opposite the leg to which the plate means is attached, the opposite legs being joined by a vertex portion, and said attaching means further includes a third generally U-shaped convolution located between said second U-shaped convolution and said blade means, the third convolution being formed of two legs joined by a vertex portion, the vertex portion of the third convolution and the vertex portion of the second convolution being so located and of the requisite height one to the other, such that when said second convolution is pressingly located within said open ended area of confinement, the third convolution is inwardly open and its vertex portion is located in pressing engagement with the leg of the first convolution opposite the leg to which the plate means is attached, in a lateral plane more outwardly located from that of the vertex portion of said first convolution thereby causing said first convolution to press laterally on said second convolution for increasing retention within said open ended area of confinement.

5. The combination of claim 4 wherein said second convolution is of a normal width slightly greater than that of the open area of confinement and is sufficiently flexible in the lateral direction so as to be capable of being flexed to a dimension capable of being manually press fit within said open area of confinement.

6. The combination of claim 5 wherein said container is a cylindrical can, the orifice of said can is its upper end, said can being provided with a top for closing said orifice, said top including a generally U-shaped fourth convolution adjacent the peripheral edge of said top, said generally U-shaped fourth convolution of said top being capable of being tightly fit within and engaging the outwardly open surface of the generally U-shaped first convolution thereby to seal said orifice without interference with the blade means and attaching means therefor.

* * * * *